US012384494B1

(12) United States Patent
Pierce

(10) Patent No.: US 12,384,494 B1
(45) Date of Patent: Aug. 12, 2025

(54) CARPET AND DECKING ASSEMBLY

(71) Applicant: Arkansas Boats, LLC, Orlando, FL (US)

(72) Inventor: Richard D. Pierce, Mountain Home, AR (US)

(73) Assignee: ARKANSAS BOATS, LLC, Orlando, FL (US)

( * ) Notice: Subject to any disclaimer, the term of this patent is extended or adjusted under 35 U.S.C. 154(b) by 587 days.

(21) Appl. No.: 17/881,533

(22) Filed: Aug. 4, 2022

Related U.S. Application Data

(60) Provisional application No. 63/229,100, filed on Aug. 4, 2021.

(51) Int. Cl.

| | |
|---|---|
| ***B63B 17/00*** | (2006.01) |
| ***B63B 3/48*** | (2006.01) |
| ***B63B 5/24*** | (2006.01) |

(52) U.S. Cl.
CPC ..... *B63B 17/00* (2013.01); *B63B 3/48* (2013.01); *B63B 5/24* (2013.01)

(58) Field of Classification Search
CPC ..... B63B 17/00; B63B 3/48; B63B 5/24
See application file for complete search history.

(56) References Cited

U.S. PATENT DOCUMENTS 5,190,710 A * 3/1993 Kletecka ..... C08K 5/1345 8/597

* cited by examiner

*Primary Examiner* — S. Joseph Morano
*Assistant Examiner* — Jovon E Hayes
(74) *Attorney, Agent, or Firm* — Allen, Dyer, Doppelt + Gilchrist, PA

(57) ABSTRACT

A carpet and decking assembly includes both a decking panel and carpeting covering the same substrate and meeting at an interface under which the substrate is completely obscured without the use of any additional transition piece. Advantageously, an edge of the decking panel is undercut at the interface and an edge of the carpeting extends at least partially thereunder.

20 Claims, 1 Drawing Sheet

CARPET AND DECKING ASSEMBLY

CROSS-REFERENCE TO RELATED APPLICATION

This application claims the benefit of U.S. Provisional Patent Application Ser. No. 63/229,100, filed on Aug. 4, 2021, the contents of which are herein incorporated by reference in their entirety.

FIELD OF THE INVENTION

The present invention relates to the combination of carpet and decking, and more particularly, to a carpet and decking assembly used to cover lids on watercraft.

BACKGROUND OF THE INVENTION

Synthetic foam decking, for example made from Polyvinyl chloride (PVC) or Ethylene vinyl acetate (EVA) foam material, has become very popular for marine applications due to its favorable properties and highly customizable appearance. For example, the use of foam decking panels made to resemble traditional teak decking has become widespread, offering a classic appearance with a fraction of the maintenance required by more traditional materials. Carpeting, particularly made from durable and color-fast synthetic fibers, is also very popular and useful for marine applications. Because of its intrinsic flexibility, carpeting can be folded around curved surfaces-like the peripheral lips of lids-giving it not only aesthetic and tactile appeal but offering padding and chaffing resistance between parts. It would be desirable if there were a way to have the advantages of both carpeting and synthetic decking—particularly on movable components like lids—without unduly increasing the complexity of installation.

SUMMARY OF THE INVENTION

In view of the foregoing, it is an object of the present invention to provide a carpet and decking assembly that includes both a decking panel and carpeting covering the same substrate and meeting at an interface under which the substrate is completely obscured without the use of any additional transition piece. Advantageously, an edge of the decking panel is undercut at the interface and an edge of the carpeting extends at least partially thereunder.

According to an embodiment of the present invention, a carpet and decking assembly comprises a substrate, a decking panel and carpeting. The decking panel has panel outer and inner panel surfaces, the outer panel surface facing away from the substrate and the inner panel surface adjoining the substrate, the decking panel having an undercut panel edge. The carpeting has outer and inner carpeting surfaces, the carpeting outer surface facing away from the substrate and being formed by a tuft of the carpeting and the carpeting inner surface adjoining the substrate. The carpeting has a carpeting edge that meets the undercut panel edge along an interface, with the tuft of the carpeting outer surface along the carpeting edge extending under the undercut panel edge.

According to an aspect of the present invention, the substrate is a lid. Advantageously, the carpeting material extends under a distal end of a peripheral lip of the lid.

According to a method aspect, a method of making a carpeting and decking assembly comprises forming an undercut edge on a decking panel, and attaching the decking panel and carpeting to a substrate such that, along an interface between the undercut edge and an edge of the carpeting, a tuft of the carpeting extends under the undercut edge.

These and other objects, aspects and advantages of the present invention will be better appreciated in view of the drawings and following detailed description of preferred embodiments.

DETAILED DESCRIPTION OF PREFERRED EMBODIMENTS

Figure 1:
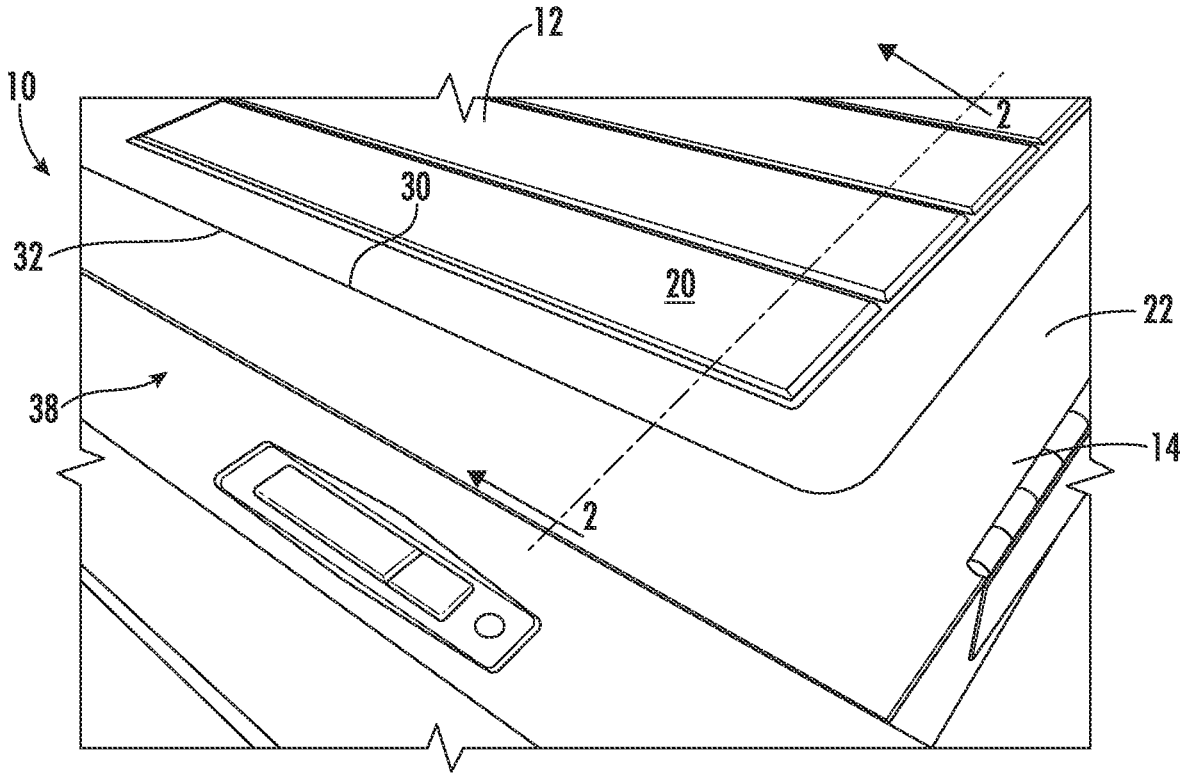
FIG. 1 is a perspective view of a carpet and decking assembly, according to an embodiment of the present invention, applied as part of a lid.
Figure 2:
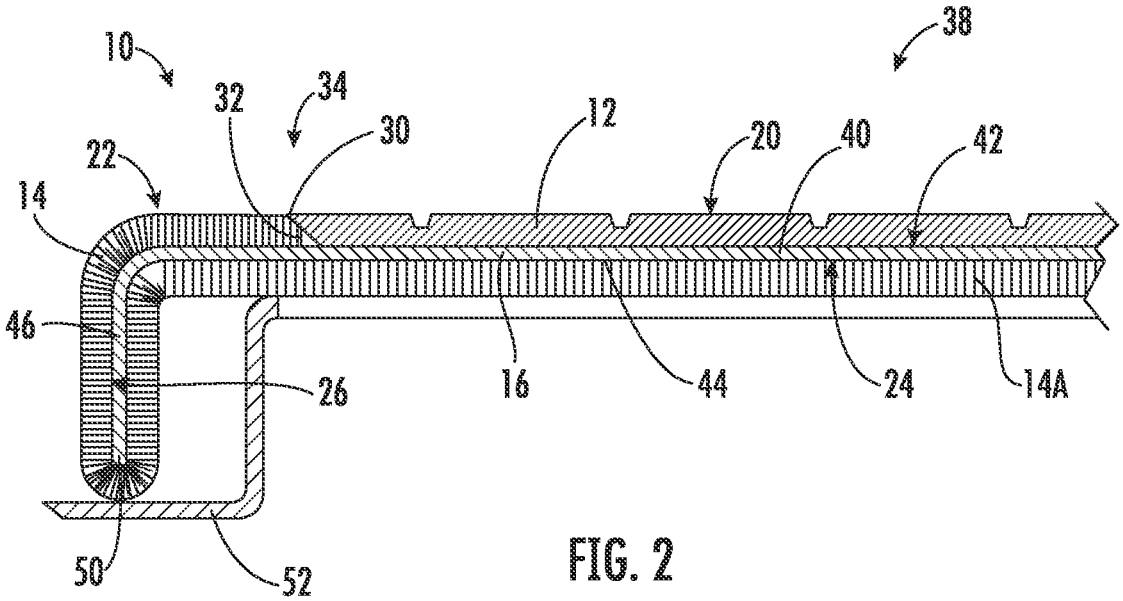
FIG. 2 is a sectional view taken along line 2-2 of FIG. 1.

According to an embodiment of the present invention, referring to FIGS. 1 and 2, a carpet and decking assembly 10 includes a decking panel 12 and carpeting 14 covering a substrate 16. The decking panel 12 and carpeting 14 have respective outer surfaces 20, 22 facing away from the substrate 16 and inner surfaces 24, 26 adjoining the substrate 16, the carpeting outer surface 22 being formed by a tuft of the carpeting 14. Respective edges 30, 32 of the decking panel 12 and the carpeting 14 meet along an interface 34. The decking panel edge 30 is undercut along the interface 34 and the tuft of the carpeting outer surface 22 along the carpeting edge 32 extends under the undercut decking panel edge 30. Consequently, the substrate 16 is not visible therebetween and a clean transition is made between the decking panel 12 and the carpeting 14 without the need for any specialized transition pieces.

The decking panel 12 is preferably a polymer foam material, and most preferably a Polyvinyl chloride (PVC) or Ethylene vinyl acetate (EVA) foam material. In an advantageous embodiment, the decking panel 12 is a polymer foam material shaped and colored to give the appearance of wood decking material, such as teak planks. The undercut edge 30 can have various profiles, including a bevel, a chamfer or a curve. Optimally, the profile allows the carpeting inner surface 26 to extend sufficiently below the deck panel outer surface 20 for the tuft to fold over and give a gapless appearance. A small air gap 36 can remain between the decking panel 12 and the carpeting material 14 under the deck panel outer surface 20. The undercut edge 30 can be pre-formed into the decking panel 12 or cut post-forming, preferably with a specialized tool allowing quick and reliable precise formation of the same undercut profile.

Any suitable material can be selected for the carpeting 14, although carpeting made from synthetic fibers is generally preferable, and for marine and other outdoor applications, the water- and wear-resistance of the carpeting 14 is preferably both suitable for the intended application and comparable to that of the decking panel 12. The height of carpeting 14 between the inner surface 26 and outer surface 22 (formed by the tuft) is preferably approximately equal to, or slightly greater than, the height of the decking panel 12 between its inner and outer surfaces 24, 20.

The carpet and decking assembly 10 can be used with any substrate 16 but is particularly advantageous for use on watercraft and, most particularly, where—as in the depicted embodiment—the substrate 16 is part of a lid 38. The lid 38 has main body 40 with an exterior side 42 and interior side 44. The lid 38 also includes a lip 46 extending around a periphery of the main body 40 away from the exterior side 42 and forming an angle of less than 180 degrees with the interior side 44, and more preferably forming an angle of approximately 90 degrees. The carpeting 14 is folded around a distal end 50 of the lip 46. Carpeting 14A can also extend across the interior side 44 of the lid 38, either as a separate piece, or a continuation of the carpeting 14.

Beyond the elimination of the need for any special transition piece between the deck paneling 12 and the carpeting 14, including the carpeting 14 in addition to the paneling 12 affords additional advantages. For example, the padding provided by the carpeting 14 wrapped around the distal end 50 of the lip 46 eliminates rattling and chaffing between the lip 46 and underlying structure 52. On lids where carpeting is not used, a separate U-shaped seal and/or button padding is typically must be provided for this purpose—which often yields inferior performance and eventual degradation of the gelcoat on the underlying structure.

Another advantage is that a completely finished appearance for the lid, inside and out, can be afforded using only a reverse finished fiberglass lid (i.e., having gelcoat only on the interior side). With carpeting covering the interior side, as in the depicted embodiment, a completely finished appearance can even be afforded using a simple aluminum lid.

The above-described embodiments are provided for illustrative purposes; the present invention is not necessarily limited thereto. Rather, those skilled in the art will appreciate that various modifications, as well as adaptations to particular circumstances, will fall within the scope of the invention herein shown and described.

What is claimed is:

1. A carpet and decking assembly comprising:

a substrate a decking panel having panel outer and inner panel surfaces, the outer panel surface facing away from the substrate and the inner panel surface adjoining the substrate, the decking panel having an undercut panel edge; and carpeting having outer and inner carpeting surfaces, the carpeting outer surface facing away from the substrate and being formed by a tuft of the carpeting and the carpeting inner surface adjoining the substrate, the carpeting having a carpeting edge meeting the undercut panel edge along an interface with the tuft of the carpeting outer surface along the carpeting edge extending under the undercut panel edge.

2. The assembly of claim 1, wherein the decking panel is made of a polymer foam material.

3. The assembly of claim 2, wherein the polymer foam material is at least one of a Polyvinyl chloride (PVC) foam material and a Ethylene vinyl acetate (EVA) foam material.

4. The assembly of claim 2, wherein the decking panel is shaped and colored to give an appearance of wood decking material.

5. The assembly of claim 1, wherein a portion of the tuft along the interface folds under the undercut deck edge giving a gapless appearance along the interface.

6. The assembly of claim 5, wherein an air gap exists between the decking panel and the carpeting material under the undercut panel edge along the interface.

7. The assembly of claim 1, wherein the carpeting is made from synthetic fibers.

8. The assembly of claim 1, wherein a height of the carpeting between the inner and outer carpeting surfaces is at least equal a height of the decking panel between the inner and panel surfaces.

9. The assembly of claim 1, wherein the substrate is part of a lid.

10. The assembly of claim 9, wherein the lid has a main body with an exterior side and an interior side, the interface between the decking panel and the carpeting being on the exterior side.

11. The assembly of claim 10, wherein the lid also includes a lip extending around a periphery of the main body away from the exterior side and forming an angle of less than 180 degrees with the interior side, the carpeting being folded around a distal end of the lip.

12. The assembly of claim 11, wherein the carpeting also extends across the interior side of the lid.

13. The assembly of claim 12, wherein the lid is made of aluminum.

14. The assembly of claim 1, wherein the undercut deck edge is formed as at least one of a bevel, a chamfer and a curve.

15. A method of making a carpeting and decking assembly, the method comprising:

forming an undercut edge on a decking panel; and attaching the decking panel and carpeting to a substrate such that, along an interface between the undercut edge and an edge of the carpeting, a tuft of the carpeting extends under the undercut edge.

16. The method of claim 15, wherein the decking panel is attached such that a portion of the tuft along the interface folds under the undercut edge giving a gapless appearance.

17. The method of claim 16, wherein the decking panel is attached such that an air gap remains between the carpeting and the decking panel under the undercut edge.

18. The method of claim 15, wherein the decking panel is formed of a polymer foam material.

19. The method of claim 18, wherein the polymer foam material is at least of a Polyvinyl chloride (PVC) foam material and a Ethylene vinyl acetate (EVA) foam material.

20. The method of claim 15, wherein the substrate is a lid and the carpeting is attached so as to extend around a distal end of a peripheral lip of the lid.

* * * * *